US010082056B2

(12) United States Patent
Tsukamoto et al.

(10) Patent No.: US 10,082,056 B2
(45) Date of Patent: Sep. 25, 2018

(54) ENGINE LUBRICATION STRUCTURE AND MOTORCYCLE

(71) Applicant: SUZUKI MOTOR CORPORATION, Hamamatsu-shi, Shizuoka (JP)

(72) Inventors: Kohei Tsukamoto, Hamamatsu (JP); Shintaro Yagi, Hamamatsu (JP); Tomoyuki Oda, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 99 days.

(21) Appl. No.: 15/279,108

(22) Filed: Sep. 28, 2016

(65) Prior Publication Data

US 2017/0114684 A1 Apr. 27, 2017

(30) Foreign Application Priority Data

Oct. 27, 2015 (JP) ..... 2015-210360

(51) Int. Cl.

| | |
|---|---|
| ***F01M 11/02*** | (2006.01) |
| ***F02B 61/02*** | (2006.01) |
| ***F02B 39/14*** | (2006.01) |
| ***F01M 11/00*** | (2006.01) |

(52) U.S. Cl.

CPC ..... *F01M 11/02* (2013.01); *F01M 11/0004* (2013.01); *F02B 39/14* (2013.01); *F02B 61/02* (2013.01); *F01M 2011/0033* (2013.01); *F01M 2011/021* (2013.01)

(58) Field of Classification Search

CPC ..... F01M 11/02; F01M 11/0004; F01M 2011/0033; F01M 2011/021; F02B 61/02; F02B 39/14

USPC ..... 60/605.1

See application file for complete search history.

(56) References Cited

U.S. PATENT DOCUMENTS

| | | | | |
|---|---|---|---|---|
| 2008/0277201 | A1* | 11/2008 | Taguchi | F01M 11/02 184/6.5 |
| 2014/0360454 | A1* | 12/2014 | Valencia | F01M 11/02 123/196 CP |
| 2015/0361839 | A1* | 12/2015 | Kimura | F01M 5/002 123/196 A |
| 2016/0237867 | A1* | 8/2016 | Zahdeh | F01M 11/0004 |

FOREIGN PATENT DOCUMENTS

| | | |
|---|---|---|
| JP | 60-36758 Y2 | 10/1985 |

* cited by examiner

*Primary Examiner* — Hoang Nguyen
(74) *Attorney, Agent, or Firm* — Stein IP, LLC

(57) ABSTRACT

An engine lubrication structure supplies oil stored in an oil pan disposed under a crank case to individual components in the crank case, and includes: a turbocharger which compresses intake air with exhaust gas of an engine; an oil passage which supplies oil to the turbocharger; and an oil return passage which returns oil from the turbocharger to the oil pan, and the crank case is provided with a connection port of the oil return passage, and the connection port is disposed below an oil surface that occurs during operation of the engine and above an oil surface that occurs when a side stand is used.

4 Claims, 9 Drawing Sheets

ENGINE LUBRICATION STRUCTURE AND MOTORCYCLE

CROSS-REFERENCE TO RELATED APPLICATIONS

This application claims the benefit of Japanese Patent Application JP 2015-210360, filed Oct. 27, 2015, the entire content of which is hereby incorporated by reference, the same as if set forth at length.

FIELD OF THE INVENTION

The present invention relates to a lubrication structure of an engine having a turbocharger and a motorcycle having the lubrication structure.

BACKGROUND OF THE INVENTION

Motorcycles having a turbocharger are known in which exhaust gas of the engine is used as a drive source of the turbocharger. In these motorcycles, an exhaust manifold is attached to an exhaust port formed in a cylinder head and the turbocharger is attached to the exhaust manifold.

In turbochargers, usually, proper lubrication is done in such a manner that part of oil that circulates through an engine is supplied to a drive unit of the turbocharger (refer to JP-UM-B-60-36758, for example). JP-UM-B-60-36758 discloses a turbocharger lubrication structure in which oil that is pumped up from an oil pan by a pump is supplied to a turbocharger via an oil supply passage and then returned to the oil pan via an oil return passage.

SUMMARY OF THE INVENTION

Incidentally, in JP-UM-B-60-36758, the turbocharger is disposed below an oil surface of the oil pan. As a result, a separate oil pump or a check valve needs to be installed to return oil that has been used for lubrication of the inside of the turbocharger to the oil pan. This results in increase in the number of components and hence is a factor in causing cost increase.

The present invention has been made in the above circumstances, and an object of the invention is therefore to provide an engine lubrication structure that enables lubrication of a turbocharger and returning of oil from it by means of an inexpensive structure, as well as a motorcycle having such an engine lubrication structure.

An engine lubrication structure according to the present invention supplies oil stored in an oil pan disposed under a crank case to individual components in the crank case, and comprises: a turbocharger which compresses intake air using exhaust gas of an engine; an oil passage which supplies oil to the turbocharger; and an oil return passage which returns oil from the turbocharger to the oil pan, wherein the crank case is provided with a connection port of the oil return passage, and the connection port is disposed below an oil surface that occurs during operation of the engine and above an oil surface that occurs when a side stand is used.

In this configuration, while the engine is in operation, since the connection port of the oil return passage is located below the oil surface, oil that has been used for lubrication of the turbocharger is returned to the oil pan so as to directly join the oil existing there. This prevents generation of bubbles through stirring of the oil surface and lowering of the lubrication performance. Furthermore, when the side stand is used after a stop of the engine, since the outlet port of the oil return passage is located above the oil surface, oil is returned to the oil pan so as to enter it from a position that is higher than the oil surface. Thus, oil can be discharged smoothly from the turbocharger. In summary, it is not necessary to return oil that has been used for lubrication of the turbocharger to the oil pan using a separate pump and hence lubrication of the turbocharger and returning of oil from it can be realized by an inexpensive structure.

Further, in the engine lubrication structure according to the present invention, it is preferable: that the turbocharger is disposed above the oil pan; and that the connection port is disposed at a front surface of the crank case on the opposite side to the side stand in the left-right direction. With this configuration, when the side stand is used, oil can be returned to the oil pan utilizing its own weight, which means increase in oil dischargeability.

Further, in the engine lubrication structure according to the present invention, it is preferable that the oil return passage is larger in sectional area than the oil passage. With this configuration, the resistance of the oil return passage against returning oil can be reduced, which means increase in oil dischargeability.

Further, a motorcycle according to the present invention comprises the engine lubrication structure.

The invention can realize lubrication of the turbocharger and returning of oil from it by means of an inexpensive structure because the position of the connection port of the oil return passage with respect to the oil surface when the engine is in operation is made different from that when the engine is stopped.

DESCRIPTION OF SYMBOLS

1: Engine
2: Turbocharger
24*a*: Inlet pipe (oil passage)
24*b*: Outlet pipe (oil return passage)
4: Crank case
40*a*: Connection port (oil passage)
41*a*: Connection port (oil return passage)
5: Oil pan
L1, L2: Oil surface

DETAILED DESCRIPTION OF THE INVENTION

An embodiment of the present invention will be hereinafter described in detail with reference to the accompanying drawings. The embodiment is such that the lubrication structure of an engine having a turbocharger according to the invention is applied to a motorcycle. However, the invention is not limited to this case and can also be applied to other kinds of vehicles such as other types of motorcycles, buggy-type motor tricycles, and automobiles. As for the directions relating to the vehicle, the forward, rearward, leftward, and rightward directions will be indicated by arrows FR, RE, L, and R, respectively. It is also noted that in each drawing part of the components and members are omitted for convenience of description.

Figure 1:
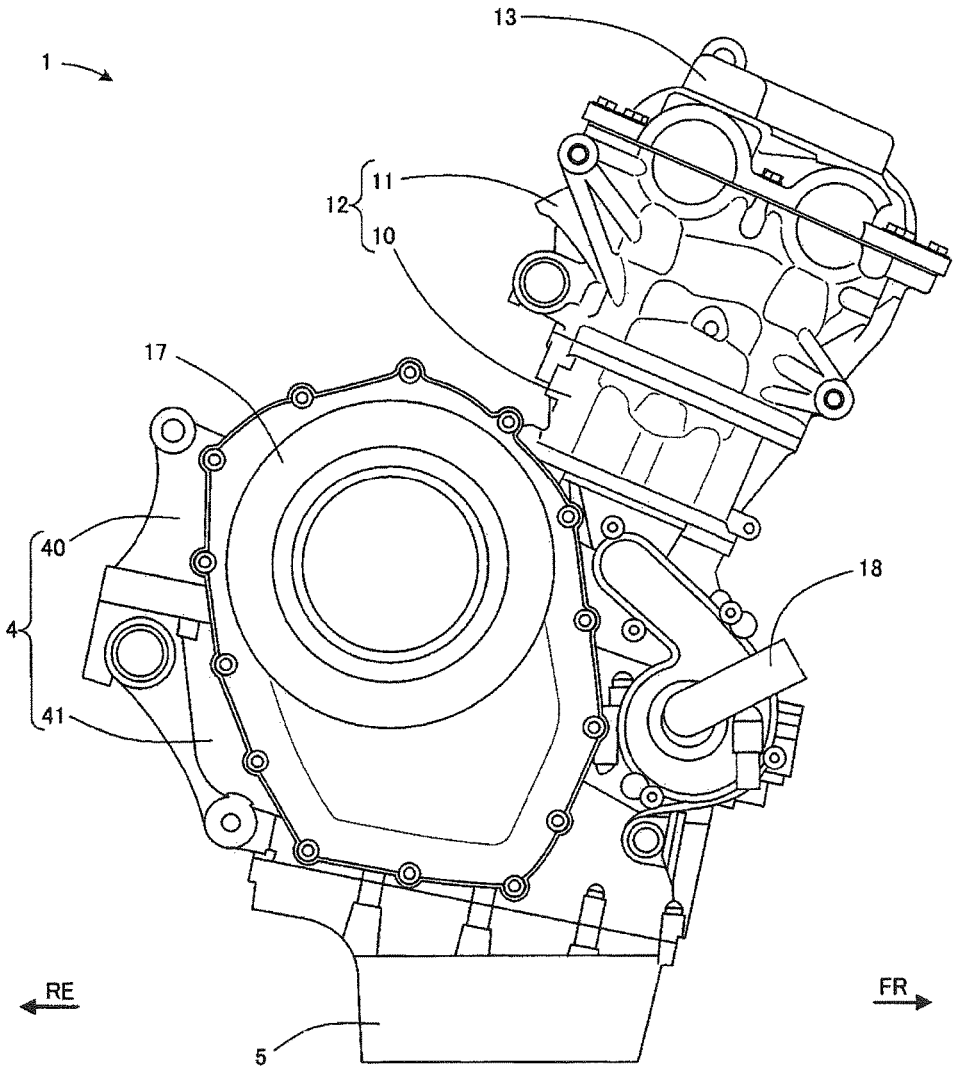
FIG. 1 is a right side view showing a schematic configuration of an engine of a motorcycle according to an embodiment of the present invention.
Figure 2:
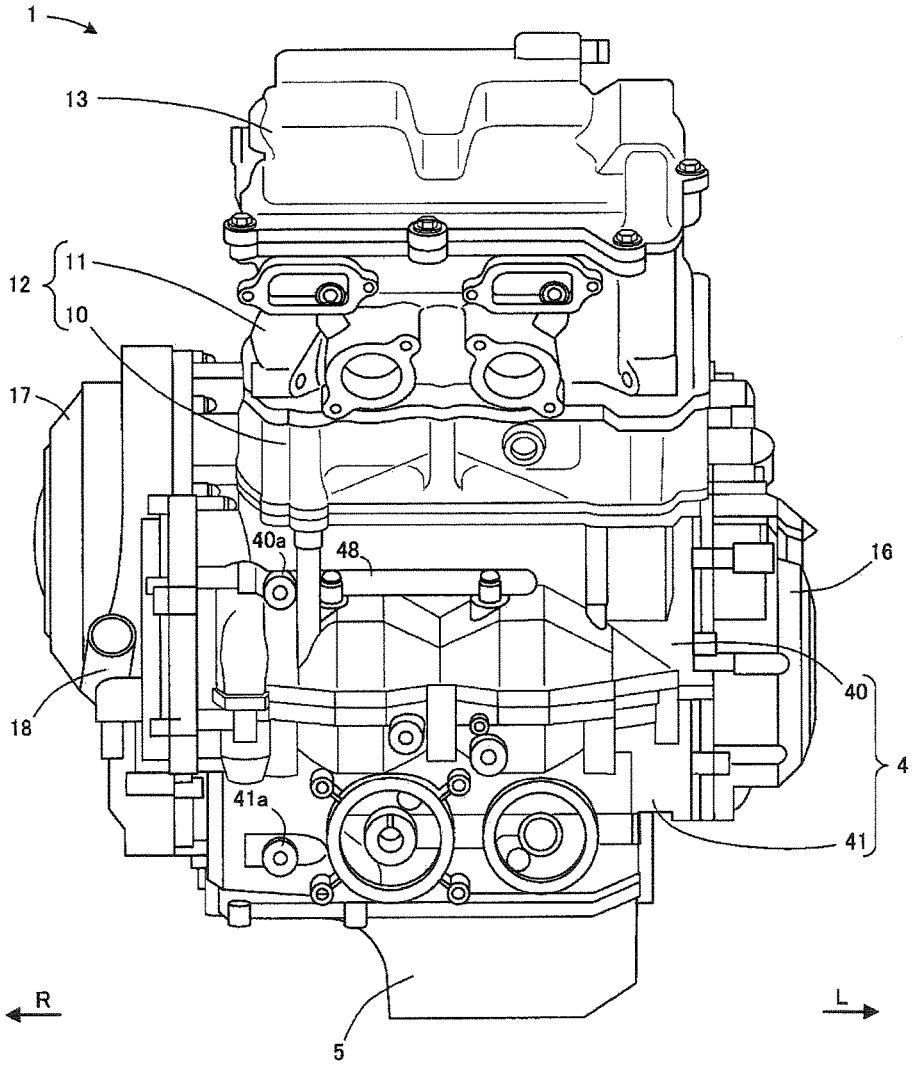
FIG. 2 is a front view of the engine shown in FIG. 1.
Figure 3:
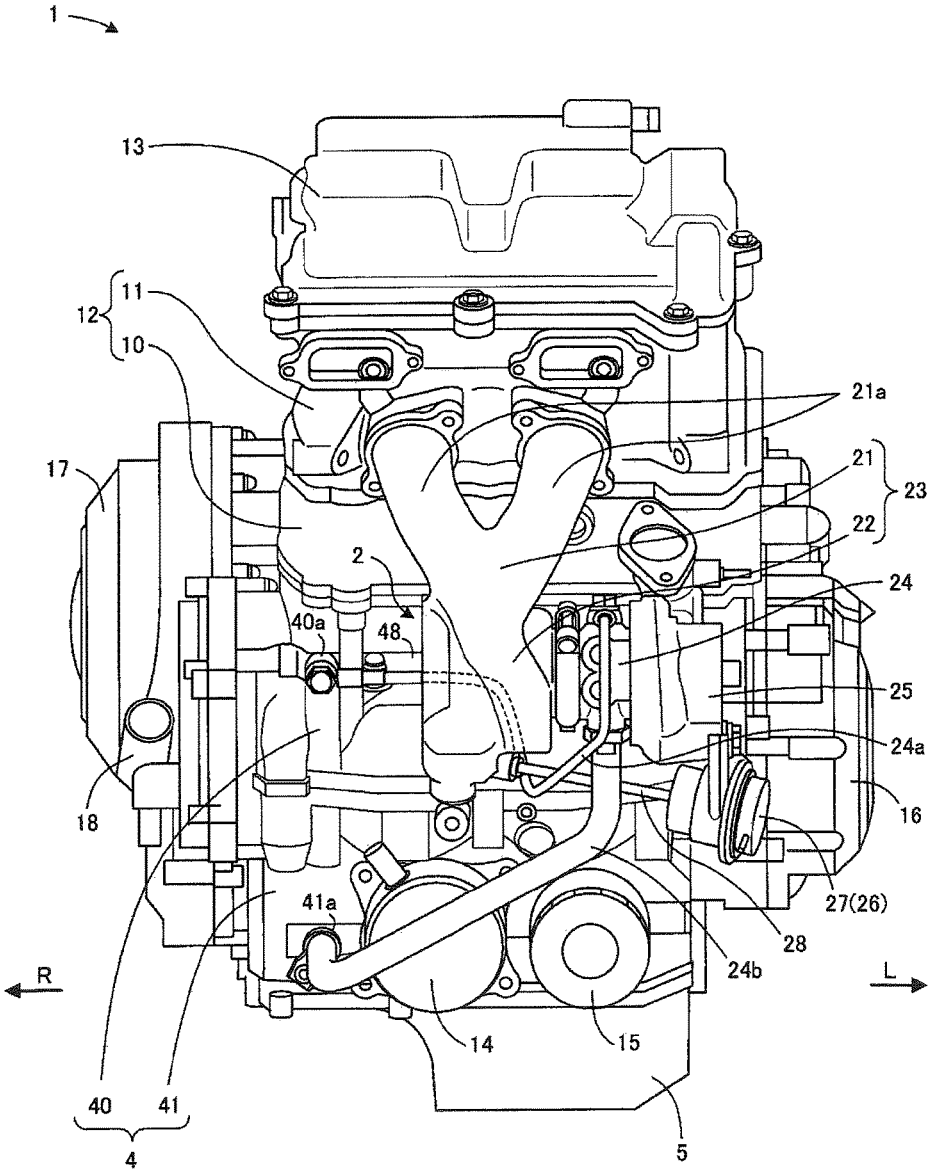
FIG. 3 is a front view of the engine according to the embodiment including a turbocharger.
Figure 4:
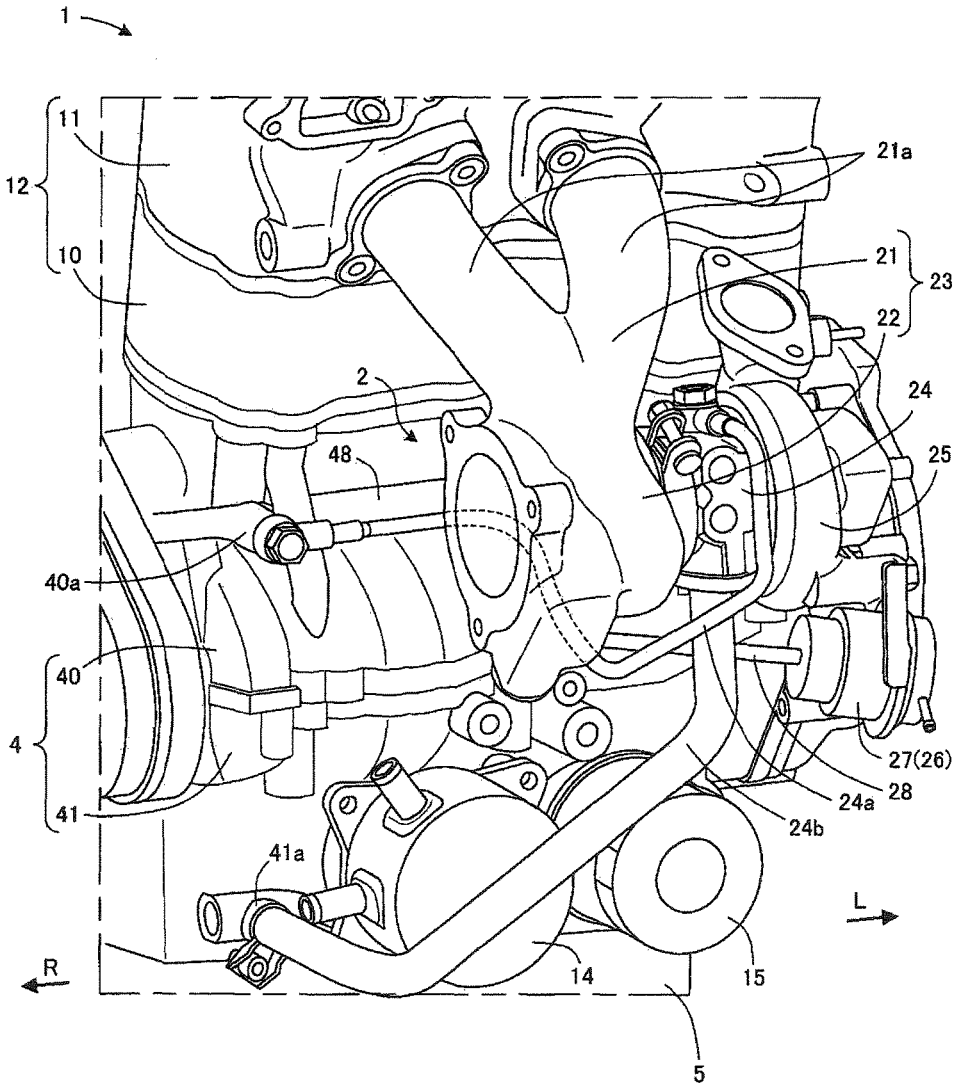
FIG. 4 is a perspective view of part of the engine according to the embodiment including the turbocharger.

First, a general configuration of a motorcycle according to the embodiment will be described with reference to FIGS. 1-4. FIG. 1 is a right side view showing a schematic configuration of an engine 1 of the motorcycle according to the embodiment. FIG. 2 is a front view of the engine 1. FIG. 3 is a front view of the engine 1 including a turbocharger 2. FIG. 4 is a perspective view of part of the engine 1 including the turbocharger 2. In FIGS. 1 and 2, the turbocharger 2 and other components and members are omitted for convenience of description.

As shown in FIGS. 1 and 2, the motorcycle according to the embodiment is a motorcycle that is equipped with a turbocharger 2, that is, a supercharger that uses exhaust gas of the engine 1 as a drive source (see FIG. 3). The engine 1 is a 2-cylinder, 4-cycle internal combustion engine. The engine 1 is configured in such a manner that components such as pistons (not shown) are housed in a cylinder assembly 12 which is composed of a cylinder block 10 and a cylinder head 11 and a cylinder head cover 13 is attached to the top of the cylinder assembly 12 (cylinder head 11). A crank case 4 which houses a crank shaft (not shown) is attached to a bottom-rear portion of the cylinder assembly 12.

The crank case 4 is configured so as to be dividable in the vertical direction and has a top case 40 and a bottom case 41. A space for containing various shafts is formed in the crank case 4 by combining the top case 40 and the bottom case 41 together. A top-front portion of the top case 40 has an opening, and the cylinder block 10 is attached to the top case 40 so as to close the opening. The bottom case 41 is formed with an opening at the bottom, and an oil pan 5 is attached to the bottom case 41 so as to close the opening.

As shown in FIG. 3, an oil cooler 14 for cooling oil in the engine 1 and an oil filter 15 for filtering dirty oil are attached to a front portion of the bottom case 41 at a right position and a left position, respectively.

The crank case 4 is formed with respective openings on the left side and the right side. A magneto cover 16 (not shown in FIG. 1) which covers a magneto (not shown) is attached to the crank case 4 so as to close its left opening, and a clutch cover 17 which covers a clutch is attached to the crank case 4 so as to close its right opening.

Being a water-cooling engine, the engine 1 according to the embodiment is equipped with a water pump 18 for feeding cooling water to it. The right side surface of the crank case 4 is provided with a water pump 18 in front of the clutch cover 17. Although not shown in any drawings, a side stand for supporting a vehicle body (engine 1) is disposed on the bottom-left of the crank case 4.

As shown in FIGS. 3 and 4, the turbocharger 2 is disposed at a front position of the engine 1 so as to be close to (adjacent to) the front surface of the crank case 4. The turbocharger 2 has a housing body 23 formed by integrally molding an exhaust manifold (hereinafter referred to as a manifold portion 21) and a turbine housing (hereinafter referred to as a housing portion 22; described later). The manifold portion 21 is attached to exhaust ports of the engine 1, whereby the turbocharger 2 is fixed to the engine 1.

The housing portion 22 is shaped like a cylinder whose axis extends in the vehicle width direction (left-right direction) and houses a turbine (not shown) inside. The manifold portion 21 is connected to a top portion of the cylindrical housing portion 22. The manifold portion 21 has a connection portion that is connected to the housing portion 22 and a pair of branch pipes 21*a* which extends upward from the connection portion. Tip portions of the branch pipes 21*a* are connected to the two respective front exhaust ports of the cylinder head 11.

An exhaust pipe (not shown) is connected to a right end portion of the housing portion 22. A bearing housing 24 which houses a bearing (not shown) of a turbo shaft (not shown) is disposed on the left of the housing portion 22. A compressor housing 25 which houses a compressor (not shown) is disposed on the left of the bearing housing 24.

Figure 7:
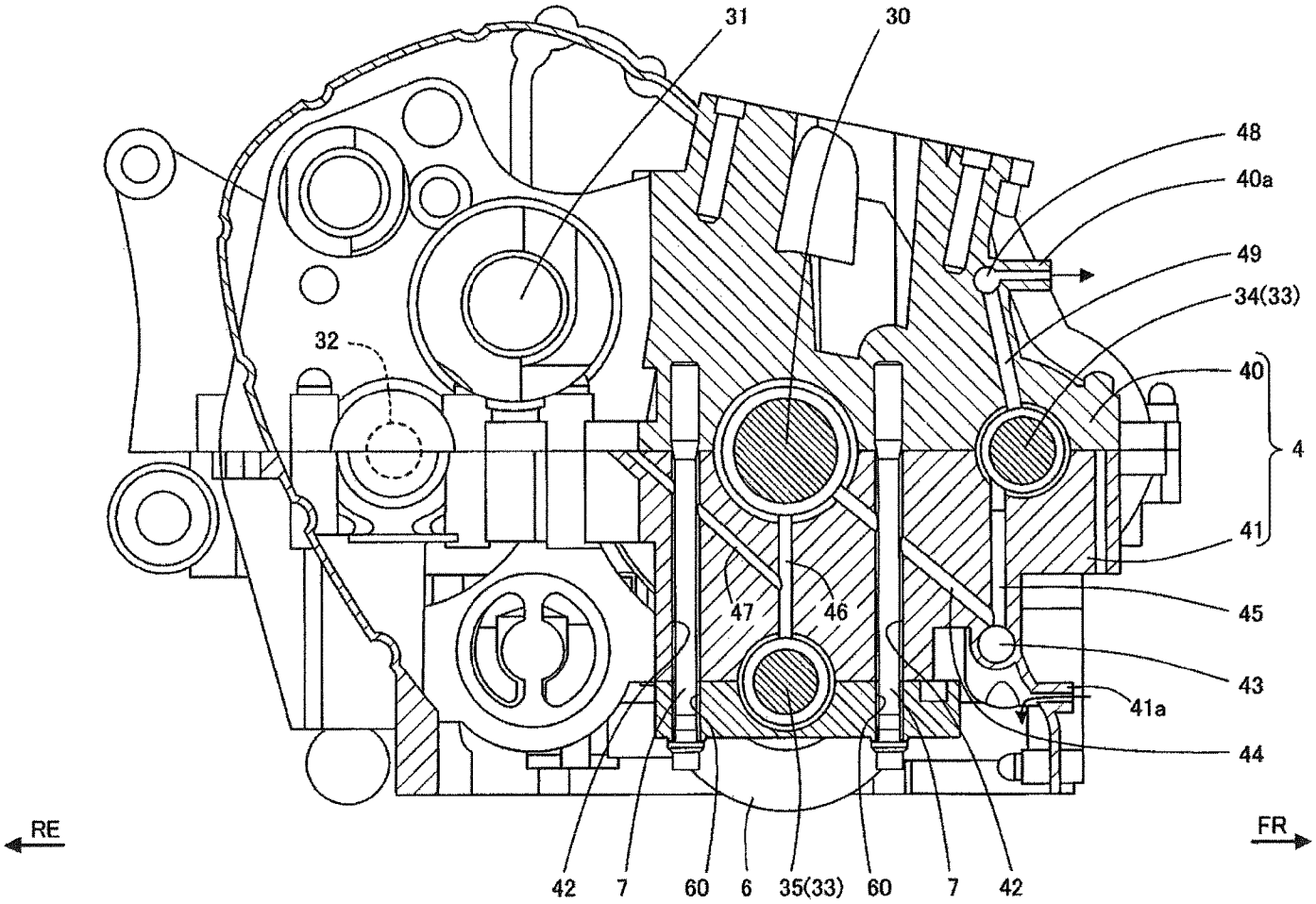
FIG. 7 is a sectional view, taken along line A-A in FIG. 5, of the crank case.

One end of an inlet pipe 24*a* for supplying oil from the crank case 4 to the turbocharger 2 is connected to a top portion of the bearing housing 24, and the other end of the inlet pipe 24*a* is connected to the top case 40. More specifically, the top case 40 is formed with, at a front-right position, a connection port 40*a* for the inlet pipe 24*a*. As shown in FIG. 7, the connection port 40*a* is cylindrical and projects forward from a right end portion of a sub-gallery 48 (described later).

The inlet pipe 24*a* extends leftward from the connection port 40*a* alongside the sub-gallery 48 and is then bent downward so as to go around the housing portion 22 (goes under it). The inlet pipe 24*a* goes under an operation shaft 28 of a waste gate valve 26 (described later) so as not to pass through a movable range of the operation shaft 28. Then the inlet pipe 24*a* extends upward alongside the housing portion 22 and is connected to a top end portion of the bearing housing 24.

One end of an outlet pipe 24*b* for returning oil that has been used for lubrication of the inside of the turbocharger 2 is connected to a bottom portion of the bearing housing 24, and the other end of the outlet pipe 24*b* is connected to the bottom case 41. More specifically, the bottom case 41 is formed with, at a front-right position, a connection port 41*a* for the outlet pipe 24*b*. The connection port 41*a* is formed on the front surface below the turbocharger 2.

A turbine is fixed to one (right) end portion of the turbo shaft which extends in the vehicle width direction between the housing portion 22 and the compressor housing 25, and the compressor is fixed to the other (left) end portion of the turbo shaft. Thus, the turbine and the compressor can rotate together on the turbo shaft.

The waste gate valve 26 is disposed below the compressor housing 25. The waste gate valve 26 has a role of adjusting the rate of inflow of exhaust gas into the turbine (housing portion 22). The waste gate valve 26 has a main body unit 27 for adjusting the flow rate of exhaust gas inside the housing portion 22 by detecting the pressure in the compressor housing 25. The main body unit 27 is disposed below the compressor housing 25, and the operation shaft 28 which extends toward the housing portion 22 is attached to the main body unit 27.

A valve plug (not shown) is attached to the housing-portion-22-side tip of the operation shaft 28. The valve plug causes opening of closure as the operation shaft 28 is operated by the main body unit 27, whereby the flow rate of exhaust gas inside the housing portion 22 is adjusted. For example, when the turbo pressure has risen rapidly, the main body unit 27 operates the operation shaft 28 so that the valve plug causes opening, whereby the rate of inflow of exhaust gas into the housing portion 22 is lowered.

A compressor pipe (not shown) for introducing, into the turbocharger 2, air that has passed through an air cleaner (not shown). An intake pipe (not shown) for introducing, into the engine 1, air that has been compressed in the compressor housing 25 is connected to a top portion of the compressor housing 25.

In the motorcycle which is equipped with the thus-configured turbocharger 2, whereas exhaust gas of the engine 1 is introduced into the housing portion 22 via the manifold portion 21 according to a throttle manipulation of a rider, external air is introduced into the compressor housing 25 via the air cleaner and the compressor pipe.

In the housing portion 22, the turbine is rotated at high speed by a flow of exhaust gas. And the exhaust gas is discharged to the outside via the exhaust pipe. In the compressor housing 25, the compressor is rotated according to the rotation of the turbine, whereby air is compressed there. The compressed air is introduced into the engine 1 via the intake pipe.

By compressing air by the turbocharger 2 in the above manner, an air-fuel mixture exceeding a total displacement of the engine 1 can be fed to the engine 1 to increase its output power.

Part of oil that circulates through the engine 1 is supplied from the sub-gallery 48 to the turbocharger 2 (bearing housing 24) via the inlet pipe 24*a*, whereby the turbo shaft and the bearing are lubricated. After being used for lubrication of the turbocharger 2, the oil is returned to the crank case 4 (oil pan 5) via the outlet pipe 24*b*. The sectional area of the outlet pipe 24*b* is larger than that of the inlet pipe 24*a*. Thus, the resistance of the oil return flow passage is reduced and hence the returning of oil from the turbocharger 2 can be performed smoothly.

Incidentally, in conventional motorcycles that are equipped with a turbocharger which compresses intake air using exhaust gas of an engine, the turbocharger is disposed in front of an oil pan. In this case, if the drive shaft (turbo shaft) of the turbocharger is disposed below an oil surface of the oil pan, oil that has been used for lubrication of the inside of the turbocharger is not returned to the oil pan easily. To solve this problem, an oil return passage of the turbocharger is provided with a separate (dedicated) oil pump (scavenging pump) which forcibly returns oil that has been used for lubrication of the turbocharger to the oil pan.

In particular, since the turbocharger is a component that heats to a very high temperature (e.g., higher than 800° C.), if oil remains inside the turbocharger after a stop of the engine, not only is deterioration of the oil accelerated by heat, but also the bearing may seize up. It is therefore desirable to discharge oil from the turbocharger as soon as the engine is stopped.

In view of the above, in the embodiment, the sub-gallery 48 for supplying oil to the shafts in the engine 1 is provided with the oil passage (connection port 40*a* and inlet pipe 24*a*) to the turbocharger 2. With this measure, not only can oil be supplied to the shafts at a sufficiently high pressure, but also oil can be supplied to the turbocharger 2. Furthermore, since the connection port 41*a* of the outlet pipe 24*b* is disposed below the turbocharger 2, oil can be discharged from the turbocharger 2 smoothly utilizing its own weight.

In particular, in the embodiment, the position of the connection port 41*a* of the oil return passage (outlet pipe 24*b*) with respect to the oil surface when the engine 1 is in operation is made different from that when the engine 1 is stopped. With this measure, while the engine 1 is in operation, the connection port 41*a* is lower than an oil surface L1 (see FIG. 9), which prevents generation of bubbles in oil. On the other hand, while the engine 1 is stopped, the connection port 41*a* is higher than an oil surface L2, which prevents oil from staying in the turbocharger 2.

Figure 5:
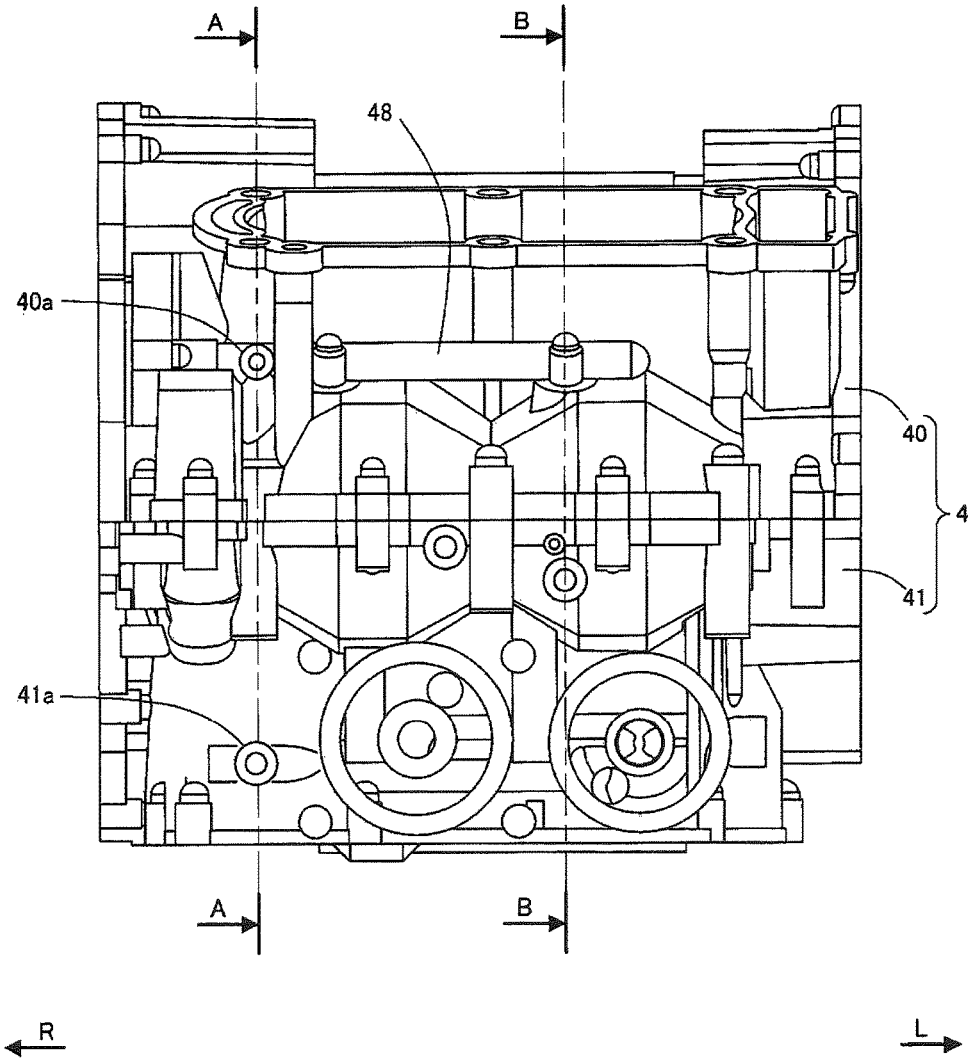
FIG. 5 is a front view of a crank case of the engine according to the embodiment.
Figure 6:
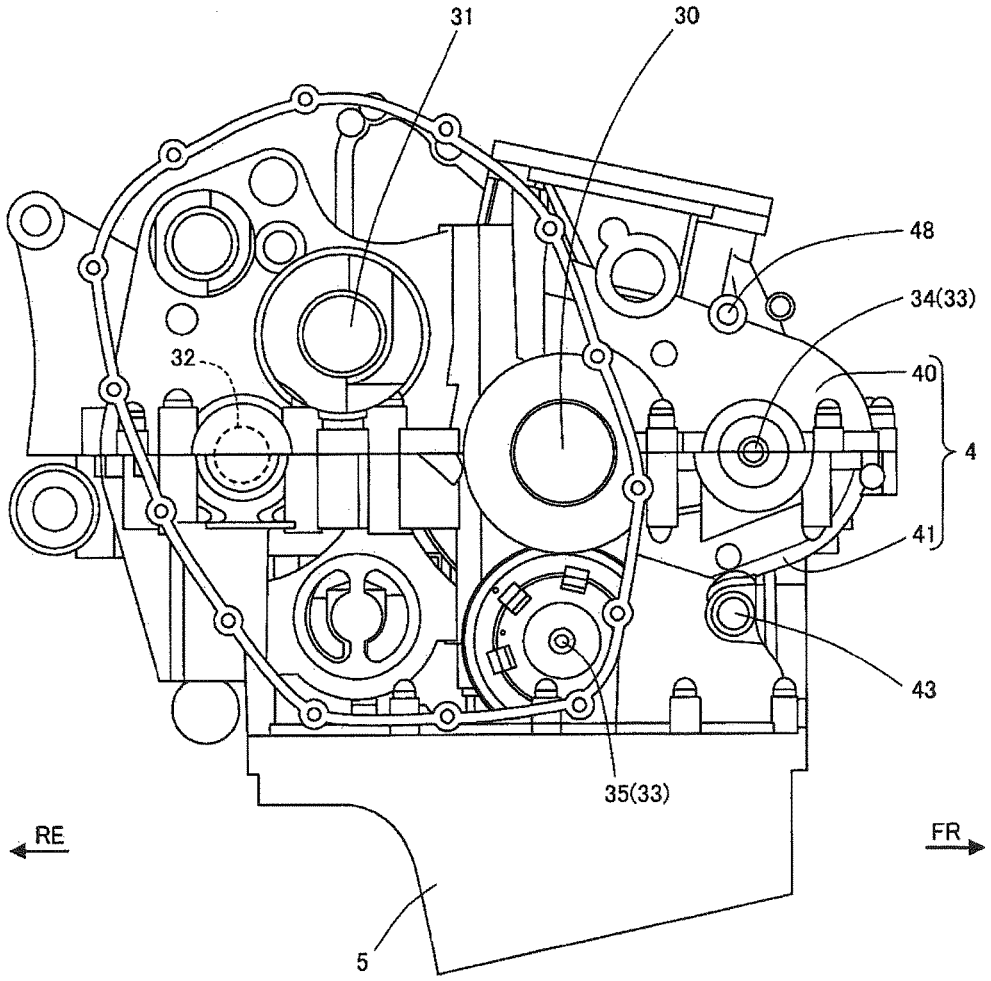
FIG. 6 is a right side view of the engine according to the embodiment from which a clutch cover is removed.
Figure 8:
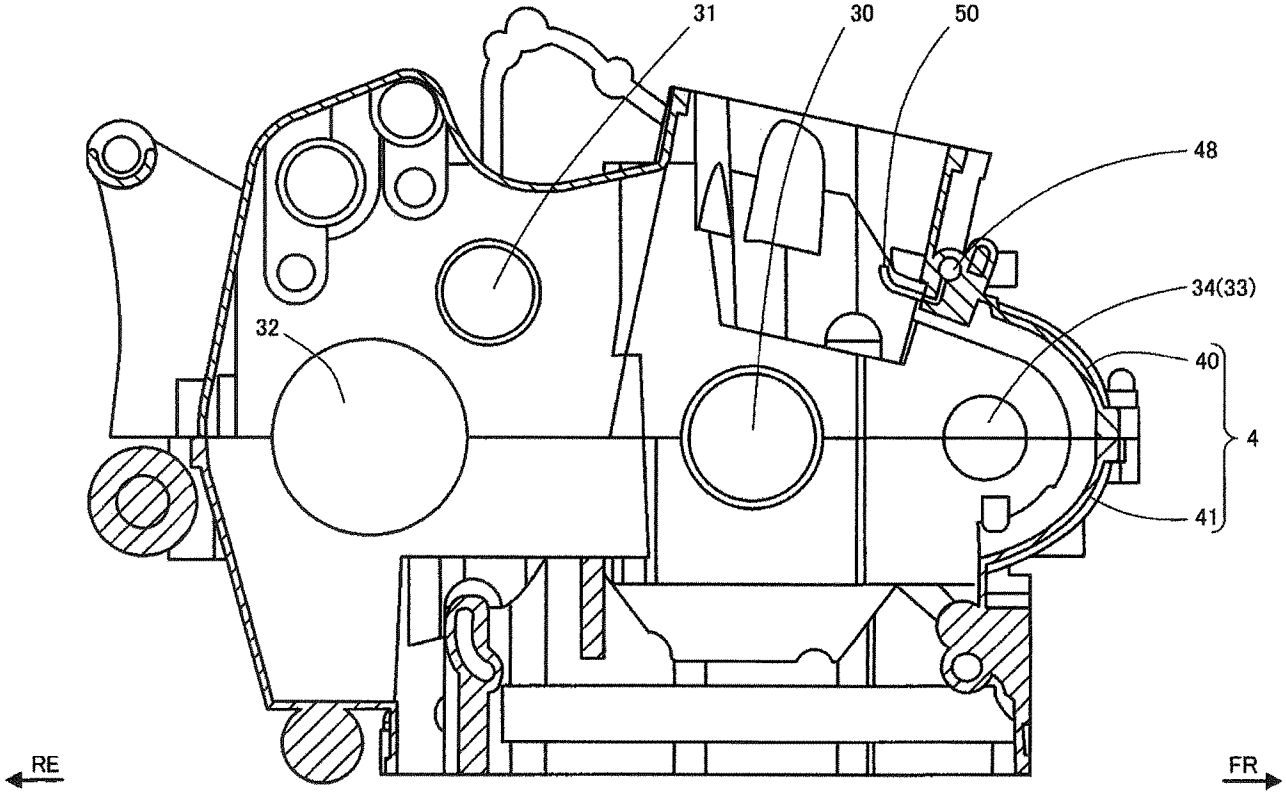
FIG. 8 is a sectional view, taken along line B-B in FIG. 5, of the crank case.

Next, referring to FIGS. 5-8, a description will be made of the arrangement of shafts in the engine 1 according to the embodiment and oil supply paths. FIG. 5 is a front view of the crank case 4 of the engine 1. FIG. 6 is a right side view of the engine 1 from which the clutch cover 17 is removed. FIG. 7 is a sectional view, taken along line A-A in FIG. 5, of the crank case 4. FIG. 8 is a sectional view, taken along line B-B in FIG. 5, of the crank case 4.

First, the arrangement of the shafts will be described. As shown in FIGS. 5 and 6, in addition to a crank shaft 30, various shafts for transmitting drive power of the engine 1 are housed in the crank case 4. In the following, a description will be made of the locations of the various shafts using the position of the crank shaft 30 as a reference. The crank shaft 30 is housed a little in front of the center of the crank case 4. Two pistons (not shown) are attached to the crank shaft 30 via respective connecting rods (not shown) and arranged in the axial direction.

A counter shaft 31 is disposed in the top-rear of the crank shaft 30. The right end of the counter shaft 31 is provided with the clutch (not shown). A drive shaft 32 is disposed in the bottom-rear of the counter shaft 31. The drive shaft 32 is provided with various shift gears. Plural (in the embodiment, two) balancer shafts 33 for preventing rotation-induced vibration of the engine 1 are disposed around the crank shaft 30.

The balancer shafts 33 include a first balancer shaft 34 which is disposed in front of the crank shaft 30 and a second balancer shaft 35 which is disposed (right) under the crank shaft 30. The first balancer shaft 34 and the second balancer shaft 35 extend parallel with the axis of the crank shaft 30, and are arranged in such a manner that the straight line connecting the first balancer shaft 34 and the crank shaft 30 and that connecting the second balancer shaft 35 and the crank shaft 30 form approximately a right angle.

As shown in FIG. 7, in the embodiment, the first balancer shaft 34, the crank shaft 30, and the drive shaft 32 are located in a joining plane of the top case 40 and the bottom case 41. More specifically, three bearings are formed in the joining plane of the top case 40 and the bottom case 41 so as to be arranged in the front-rear direction, and receive the first balancer shaft 34, the crank shaft 30, and the drive shaft 32 in this order from the front side. The second balancer shaft 35 is supported by the bottom case 41 and a balancer housing 6 which houses the second balancer shaft 35. A bearing is formed in a joining plane of the bottom case 41 and the balancer housing 6, and the second balancer shaft 35 is set in this bearing.

Plural (only two are shown in FIG. 7) through-holes 42/60 through which to insert fastening bolts 7 are formed through the bottom case 41 and the balancer housing 6. The plural through-holes 42/60 are formed at such positions that the crank shaft 30 or the second balancer shaft 35 is interposed between them. The top case 40 is formed with screw holes (not shown) at positions corresponding to the plural respective through-holes 42/60. The top case 40, the bottom case 41, and the balancer housing 6 are fixed to each other (integrated together) by inserting the fastening bolts 7 into the through-holes 42/60 from below and screwing them into the top case 40.

Now, a description will be made of the oil paths in the crank case 4. As shown in FIG. 7, a main gallery 43 which is one oil passage in the engine 1 is formed in the bottom case 41 below the first balancer shaft 34 in front of the second balancer shaft 35. The main gallery 43 extends in the left-right direction.

Oil passages 44 and 45 for supplying oil from the main gallery 43 to the crank shaft 30 and the first balancer shaft 34 and an oil passage 46 for supplying oil from the crank shaft 30 to the main gallery 43 are formed in the bottom case 41. An oil passage 47 for supplying oil to the drive shaft 32 is connected to the oil passage 46. The oil passages 44 and 47 are formed so as to penetrate through the plural through-holes 42 obliquely. With this measure, the through-holes 42 for the fastening bolts 7 can be utilized as parts of the oil passages.

On the other hand, in the top case 40, the sub-gallery 48 is formed above the first balancer shaft 34 so as to extend in the left-right direction. An oil passage 49 for supplying oil from the main gallery 43 to the sub-gallery 48 via the first balancer shaft 34 is formed in the top case 40.

In the embodiment, oil that is stored in the oil pan 5 is pumped up by an oil pump and supplied to the main gallery 43. The oil that has been supplied to the main gallery 43 is supplied to the shafts and the bearings while being kept at a sufficiently high pressure. Part of the oil, that is oil supplied to the first balancer shaft 34, is then supplied to the sub-gallery 48 via an oil passage 49.

The oil that has been supplied to the sub-gallery 48 is then supplied to the turbocharger 2 (see FIG. 3) from the connection port 40*a* via the inlet pipe 24*a*. As described later, oil is also supplied to piston jets 50 (see FIG. 8). In this manner, oil that has been used for lubrication of the first balancer shaft 34 is used again for lubrication of the turbocharger 2 and cooling of the pistons. As described above, oil can be supplied to the individual components provided inside the engine 1.

In the embodiment, the shafts are arranged in the above-described manner and the main gallery 43 and the sub-gallery 48 are formed in free regions located in the vicinities of the two balancer shafts 33. That is, the first balancer shaft 34 is disposed below the sub-gallery 48 and the main gallery 43 is formed below the first balancer shaft 34. This structure makes it possible to form the oil passages to the shafts (bearings) in the form of straight through-holes. Thus, the oil passages can be formed by simple boring and the number of machining steps can be reduced.

In particular, since the oil passage 45 from the main gallery 43 to the first balancer shaft 34 and the oil passage 49 from the first balancer shaft 34 to the sub-gallery 48 can be straight ones, the oil passages 45 and 49 can be made short, leading to suppression of reduction in oil pressure.

Since the crank shaft 30 and the second balancer shaft 35 are adjacent to each other in the bottom case 41, the oil passage 46 between the crank shaft 30 and the second balancer shaft 35 can be formed easily by boring. Thus, the crank case 4 can be made lighter than in a structure that a separate (independent) oil passage is formed utilizing unused portions of the crank case 4.

As shown in FIG. 8, part of oil that has been fed to the sub-gallery 48 goes deep into it and is supplied to the piston jets 50. The pistons (not shown) are cooled by oil that is jetted from the piston jets 50 toward them. The supply of oil to the piston jets 50 lowers the oil pressure in the sub-gallery 48. However, since the lubrication path from the main gallery 43 (see FIG. 7) to the sub-gallery 48 is different from that from the main gallery 43 the bearing of the crank shaft 30. Thus, the influence of the oil pressure reduction relating to the piston jets 50 on the oil pressure for the bearing of the crank shaft 30 can be lessened.

Since the piston jets 50 have open ends, when the engine 1 stopped and the driving of the oil pump is stopped, air inside the crank case 4 is sucked by the piston jets 50 and introduced to the turbocharger 2 (see FIG. 3) via the sub-gallery 48 and the inlet pipe 24*a* (see FIG. 3). As a result, when oil in the oil passages is replaced by air, the air can be introduced into the oil passages smoothly, which enables smooth oil discharge. Thus, the oil passages are not likely clogged with oil.

Furthermore, since the sub-gallery 48 is located above the oil surface in the crank case 4, the connection port 40*a* (see FIG. 7) of the inlet pipe 24*a* can be set above the oil surface. This increases the degree of freedom in determining the location of the connection port 41 a of the outlet pipe 24*b* which is disposed below the connection port 40*a* of the inlet pipe 24*a*.

Next, the height of the oil surface in the engine 1 will be described with reference to FIG. 9, which shows oil surface heights in the engine 1 according to the embodiment.

As described above, in the engine 1, a prescribed amount of oil is stored in the oil pan 5 which is located under the crank case 4. When the engine 1 is driven, oil in the oil pan 5 is pumped up by the oil pump (not shown) and supplied to the individual components of the engine 1. Oil that has been used for lubrication of the individual components of the engine 1 is returned to the oil pan 5.

Figure 9:
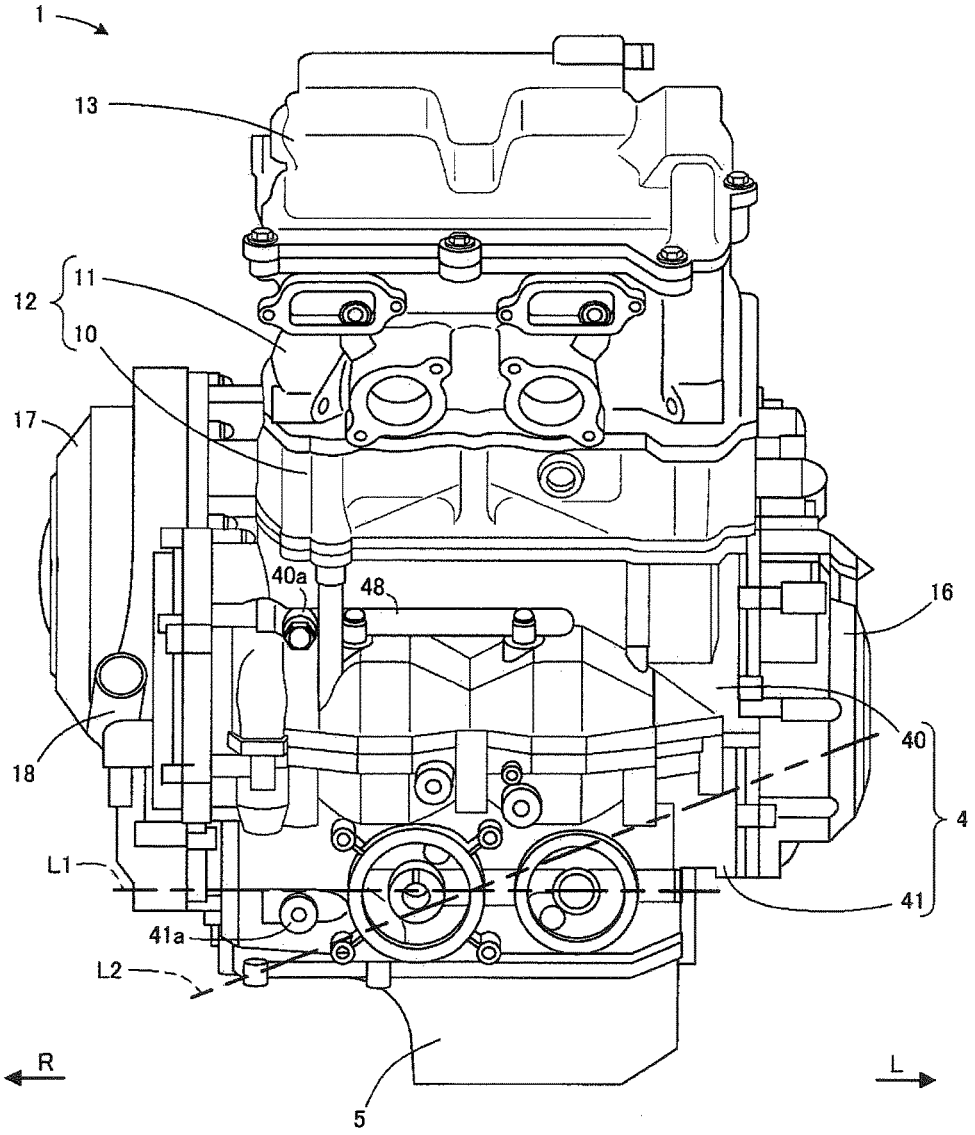
FIG. 9 shows oil surface heights in the engine according to the embodiment.

As shown in FIG. 9, while the engine 1 is in operation, the oil surface L1 indicated by a chain line is located above the connection port 41*a* of the outlet pipe 24*b* (see FIG. 3). More specifically, the center of the oil filter 15 (see FIG. 3) which is located low in the bottom case 41 is approximately at the same height as the oil surface L1. That is, while the engine 1 is in operation, the inside of the connection port 41*a* is filled with oil. Thus, oil that has been used for lubrication of the turbocharger 2 is discharged so as to directly join the oil existing in the bottom case 41. As a result, no air in the crank case 4 is mixed into the oil being discharged and hence the oil surface L1 does not get rough.

On the other hand, when the side stand is used after a stop of the engine 1, the engine 1 is inclined as the vehicle body leans toward the side of the side stand (i.e., leftward). At this time, if the oil surface L2 indicated by a two-dot chain line is regarded as a horizontal surface, it is located below the connection port 41*a* of the outlet pipe 24*b*. That is, the inside of the connection port 41*a* is located above the oil surface L2 and is in contact with the air. Furthermore, since the main body of the turbocharger 2 is located higher than the connection port 41*a*, oil is discharged from the turbocharger 2 to the bottom case 4 going down the outlet pipe 24*b* because of its own weight.

In particular, in the embodiment, the turbocharger 2 is located above the oil pan 5 and the connection port 41*a* is disposed on the front surface of the crank case 4, that is, on the side (right side) opposite to the side stand. As a result, when the side stand is used, oil can be returned to the oil pan 5 utilizing its own weight which means further increase in oil dischargeability.

As described above, oil can be discharged properly from the turbocharger 2 even after a stop of the engine 1, of course during operation of the engine 1. This makes it to possible to prevent oil deterioration due to heat generated in the turbocharger 2 and seizing-up of, for example, the bearing of the turbo shaft.

As described above, according to the embodiment, while the engine 1 is in operation, since the connection port 41*a* of the outlet pipe 24*b* is located below the oil surface L1, oil that has been used for lubrication of the turbocharger 2 is returned to the oil pan 5 so as to directly join the oil existing there. This prevents generation of bubbles through stirring of the oil surface L1 and lowering of the lubrication performance.

Furthermore, when the side stand is used after a stop of the engine 1, since the outlet port 41*a* of the outlet pipe 24*b* is located above the oil surface L2, oil is returned to the oil pan 5 so as to enter it from a position that is higher than the oil surface L2. Thus, oil can be discharged smoothly from the turbocharger 2.

In summary, it is not necessary to return oil that has been used for lubrication of the turbocharger 2 to the oil pan 5 using a separate pump and hence lubrication of the turbocharger 2 and returning of oil from it can be realized by an inexpensive structure.

The invention is not limited to the above embodiment and can be practiced by modifying it in various manners. The invention is not limited to the sizes, shapes, etc. shown in the drawings and they can be modified as appropriate within the confines that the advantages of the invention can be obtained. Other modifications can also be made as appropriate as long as the object of the invention is attained.

For example, although the above embodiment is directed to the 2-cylinder engine 1, the invention is not limited to that case; the invention can also be applied to single-cylinder engines and engines having three or more cylinders.

Although the above embodiment is directed to the water-cooling engine 1, the invention is not limited to that case; the invention can also be applied to air-cooling engines and other types of engines.

Although in the embodiment the sub-gallery 48 is disposed in front of the crank shaft 30, the invention is not limited to that case; the sub-gallery 48 may be disposed in the rear of the crank shaft 30.

Although in the embodiment oil is supplied from the sub-gallery 48 to only the turbocharger 2 and the piston jets 50, the invention is not limited to that case; oil may also be supplied from the sub-gallery 48 to the cylinder head 11 etc.

Although in the embodiment oil is supplied from the main gallery 43 to the sub-gallery 48 via the bearing of the first balancer shaft 34, the invention is not limited to that case; oil may be supplied directly to the sub-gallery 48 from the main gallery 43.

Although in the embodiment connection port 41*a* of the outlet pipe 24*b* is disposed at a front position of the engine 1, the invention is not limited to that case; the outlet pipe 24*b* may be disposed at a side position or a rear position of the engine 1.

Although in the embodiment the side stand is disposed on the left of the engine 1, the invention is not limited to that case; the side stand may be disposed on the right of the engine 1. In this case, it is preferable that the connection port 41*a* be disposed on the side (left side) opposite to the side stand.

Although in the embodiment the inlet pipe 24*a* and the connection port 40*a* (oil passage) and the outlet pipe 24*b* and the connection port 41*a* (oil return passage) have circular cross sections, the invention is not limited to that case; these oil passage and oil return passage may have proper shapes other than a circle in cross section.

Providing the above-described advantage that lubrication of the turbocharger and returning of oil from it can be realized by an inexpensive structure, the invention is particularly useful when applied to lubrication structures of engines having a turbocharger and motorcycles having such a lubrication structure.

What is claimed is:

1. An engine lubrication structure which supplies oil stored in an oil pan disposed under a crank case to individual components in the crank case, comprising:

a turbocharger which compresses intake air with exhaust gas of an engine of a vehicle having a side stand;

an oil passage which supplies oil to the turbocharger; and an oil return passage which returns oil from the turbocharger to the oil pan, wherein:

the crank case is provided with a connection port of the oil return passage, and the side stand is configured so that the connection port is disposed below an oil surface that occurs when the side stand is not used and above the oil surface when the side stand is used.

2. The engine lubrication structure according to claim 1, wherein the turbocharger is disposed above the oil pan, and the connection port is disposed at a front surface of the crank case on an opposite side to the side stand in the left-right direction.

3. The engine lubrication structure according to claim 1, wherein the oil return passage is larger in sectional area than the oil passage.

4. The engine lubrication structure according to claim 2, wherein the oil return passage is larger in sectional area than the oil passage.

* * * * *